US006243017B1

(12) United States Patent
Kuisma

(10) Patent No.: US 6,243,017 B1
(45) **Date of Patent: *Jun. 5, 2001**

(54) METHOD AND ARRANGEMENT FOR DETERMINING REMAINING OPERATING LIFE OF FLUORESCENT LAMP

(75) Inventor: Jouko Kuisma, Lahti (FI)

(73) Assignee: Teknoware Oy (FI)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/247,202

(22) Filed: Feb. 9, 1999

(30) Foreign Application Priority Data

Feb. 12, 1998 (FI) ..... 980322

(51) Int. Cl.[7] ..... G08B 21/00

(52) U.S. Cl. ..... 340/641; 340/635; 340/642; 340/660; 624/414

(58) Field of Search ..... 340/641, 635, 340/642, 657, 660, 664; 324/414

(56) References Cited

U.S. PATENT DOCUMENTS

| | | | | |
|---|---|---|---|---|
| 5,103,133 | * | 4/1992 | Misono | 313/491 |
| 5,574,335 | * | 11/1996 | Sun | 315/119 |
| 5,606,224 | | 2/1997 | Hua | 315/121 |
| 5,925,986 | * | 7/1999 | Moison | 315/247 |

FOREIGN PATENT DOCUMENTS

| | | | | |
|---|---|---|---|---|
| 0 721 437 | | 9/1996 | (EP) . | |
| 0 731 437 | | 9/1996 | (EP) | G09G/3/34 |
| 0 731 437 A2 | * | 11/1996 | (GB) . | |
| 02162696 | | 6/1990 | (JP) | H05B/41/24 |
| 02273497 | | 11/1990 | (JP) | H05B/41/24 |
| 07099090 | | 4/1995 | (JP) | H05B/41/24 |

OTHER PUBLICATIONS

Philips International B.V., Contents page and pp. 10, 19–20, and 23 relating to "Electrodes," "Influence of ambient temperature on light output", and "Lamp life and depreciation" (1987).

Philips International B.V., Contents Page and pp. 19–20 relating to "Influence of ambient temperature on light output" (1987).

Amick, "Fluorescent Lighting Manual," pp. 6–9 (McGraw–Hill, 1960).

* cited by examiner

*Primary Examiner*—Julie Lieu
(74) *Attorney, Agent, or Firm*—Leydig, Voit & Mayer, Ltd.

(57) ABSTRACT

A method for determining the remaining operating life of a fluorescent lamp, when the fluorescent lamp is connected to a starter and the fluorescent lamp comprises cathodes. The method is characterized by phases determining the amount of remaining active material in the cathode and producing an alarm signal depending on the amount of remaining active material in the cathode.

13 Claims, 2 Drawing Sheets

FIG. 1
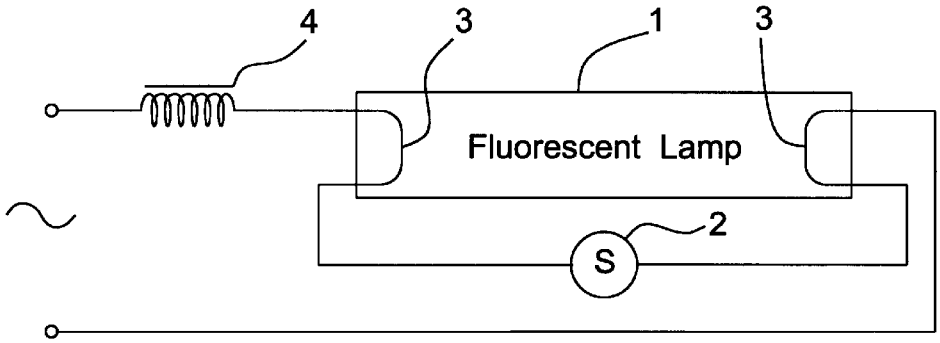
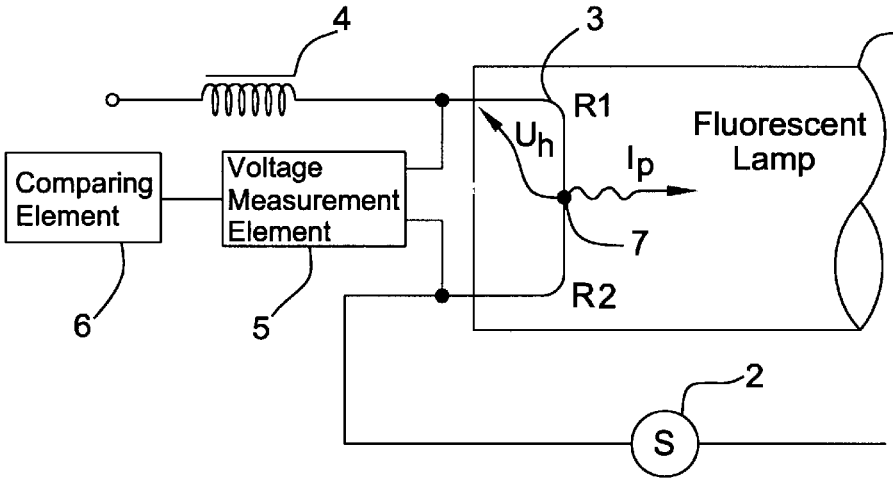
FIG. 2
FIG. 3
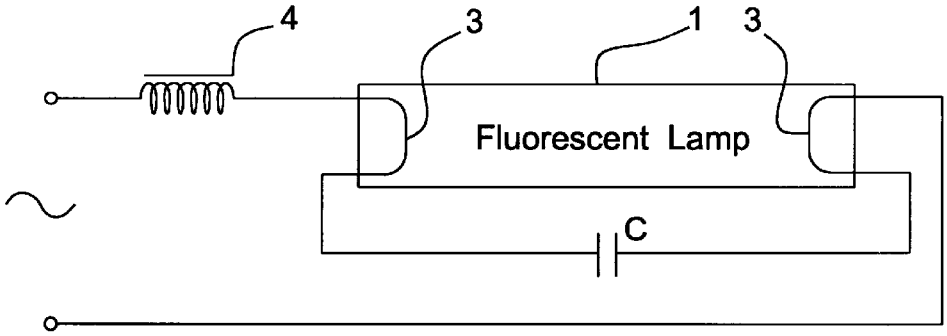

METHOD AND ARRANGEMENT FOR DETERMINING REMAINING OPERATING LIFE OF FLUORESCENT LAMP

BACKGROUND OF THE INVENTION

The invention relates to an arrangement according to the preamble of claim 1 and the preamble of claim 6 for determining the remaining operating life of a fluorescent lamp.

Fluorescent lamp lighting fixtures are generally used owing to a long operating life and good color reproduction properties. The operating life of a fluorescent lamp is mainly determined according to the durability of cathodes, which, in turn, depends mainly on the number of fluorescent lamp ignitions. The fluorescent lamps used mainly in Europe are hot cathode tubes, where the cathodes are heated to a high temperature before the lamp is actually switched on.

The cathodes are built to resemble a resistance wire for heating the cathodes of the fluorescent lamps. The cathode surface comprises an active material providing ionization that is necessary for the operation of the lamp. Through a cathode resistor a filament current is conducted which heats the cathodes before the fluorescent lamp is switched on, thus facilitating the beginning of the ionization of the active material in the cathode. The cathodes are preheated by a ballast starter system, where the current flows through both cathodes and a starter during preheating. When the cathodes are heated enough, the starter stops conducting and disconnects the filament circuit. On account of the energy stored in the ballast during the heating of the cathodes, the current starts flowing in the fluorescent lamp and produces UV radiation. The UV radiation produced by a gas breakdown is absorbed into a phosphor layer on the surface of the lamp transforming the energy of the absorbed radiation into visible light.

The operating life of fluorescent lamps depends on the amount of active material on the cathode surface, and when the active material is used up, the fluorescent lamp stops functioning. The ionization on the cathode surface of the fluorescent lamp forms a hot spot at that particular point of the cathode where the ionization occurs and the current is transferred to the gas. The hot spot travels along the cathode as the lamp is used, and is on the new lamp close to the cathode terminal, which is connected to a higher potential. As the active material of the cathodes wears, the hot spot travels along the cathode surface.

Electronic ballasts are also used for igniting or burning fluorescent lamps. Deviating from the ballast starter arrangement, a filament voltage is always connected to the cathodes when an electronic ballast is used, and so a current is constantly flowing through the cathodes. Compared with the conventional solutions, electronic control gear provide advantages that include reduced losses and thus an improved light performance.

A problem with fluorescent lamps is to determine the time for changing the lamps. It is most economical to time the change in such a manner that as little as possible of the operating life of the fluorescent lamps is left unused. Very often fluorescent lamp lighting fixtures are difficult to put in place, which is why all fluorescent lamps located in one place should preferably be changed at the same time. A typical example of such a place is a factory hall, where the floor to ceiling height and the location of the lamps above the machines or equipment impede the change.

In vehicles, an anticipating signal indicating that fluorescent lamps are burnt out makes it easier to plan the service for a vehicle. The aim is to time the vehicle service so that as many as possible of the fluorescent lamps that are almost burnt out can be changed during the service. Selecting the same time for the vehicle service and for the lamp change may reduce the number of vehicle lay days. Examples of such vehicles to be serviced are buses, railway carriages or passenger ships.

It is previously known to anticipate the end of the operating life of a fluorescent lamp by measuring the lighting voltage between the cathodes in the lamp. Patent application EP 0 731 437 A2 presents an arrangement, by which a change can be detected in the lighting voltage, before the lamp stops functioning. According to the publication after detecting a change in the voltage the current supply is cut off, and the lamp slowly dims. A drawback with the equipment of the reference publication is that the voltage to be measured above the lamp is quite high, in which case the measurement equipment should also be constructed in accordance with corresponding voltage levels. The lighting voltage greatly depends on filling gas properties, operating temperature and current change when the power supply voltage varies. Due to the facts mentioned above determining the remaining operating life of a lamp based on measuring the lighting voltage between the cathodes is very unreliable.

BRIEF DESCRIPTION OF THE INVENTION

An object of the invention is to provide a method and an arrangement that avoid the above drawbacks and enable to determine the remaining operating life of a fluorescent lamp in a more reliable manner and using simpler equipment. The object is achieved with the method of the invention, characterized by determining the amount of active material remaining in the cathode, and producing an alarm signal depending on the amount of active material remaining in the cathode.

The method of the invention is based on the fact that the remaining operating life of the fluorescent lamp can be determined on the basis of the amount of remaining active material in the cathodes. If the amount of active material in the cathodes is below a predetermined limit, an alarm signal is produced in accordance with the method.

The method of the invention has the advantage that the alarm signal can be produced while the fluorescent lamp is still functioning, in which case the fluorescent lamp can, if needed, be replaced with a new lamp. The method of the invention is also reliable and easy to implement.

The invention also relates to an arrangement for determining the remaining operating life of a fluorescent lamp, characterized by comprising means for determining the amount of active material remaining in the cathode and a means for producing an alarm signal.

Such an arrangement provides a simple and advantageous structure to achieve the advantages of the method of the invention.

BRIEF DESCRIPTION OF THE DRAWINGS

In the following the invention will be described in greater detail in connection with the preferred embodiments with reference to the accompanying drawings, in which:

FIG. 1 shows a ballast starter connection of a fluorescent lamp,

FIG. 2 shows an arrangement according to an embodiment for determining the remaining operating life of the fluorescent lamp, FIG. 3 shows a capacitor ballast connection of the fluorescent lamp.

DETAILED DESCRIPTION OF THE INVENTION

Figure 4:
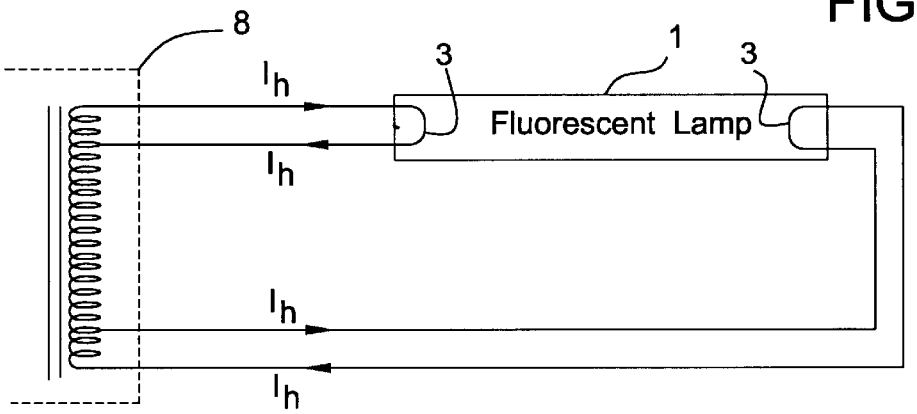
FIG. 4 shows a connection associated with the fluorescent lamp when an electronic control gear is being used.

In accordance with FIG. 1 a fluorescent lamp uses a ballast starter connection, where a choke 4 is connected between a fluorescent lamp 1 and a supplying network, and a starter 2 is in series with cathodes 3. When the ballast starter connection is used, during the heating of the cathodes, the starter is in a conducting state, but after the preheating of the cathodes 3 the starter 2 stops conducting, and the energy stored in the choke causes the voltage between the cathodes 3 to increase, and the current starts to flow through the lamp emitting radiation which is transferred into visible light at the surface layer of the fluorescent lamp.

In the connection according to FIG. 1 the current flows through the lamp by means of a gaseous filler in the lamp, when the fluorescent lamp is operating. The current is transferred from the cathode to the lamp at a point, where the cathode surface comprises an active material of the cathode that is needed for the fluorescent lamp to operate and that is at a highest possible potential. A hot spot 7 is formed according to FIG. 2 in said cathode location, from where the current is transferred from the cathode to the gas in the lamp. The hot spot is determined for the cathode in such a manner that a voltage loss $U_h$ caused by a lamp current $I_p$ on the cathode is as low as possible. As the lamp ages in use and as the active material in the cathode wears, the hot spot of the cathode moves along the cathode in such a manner that the voltage loss $U_h$ between cathode terminals caused by the current transferred from the cathode to the lamp increases. The remaining operating life of the cathode and the lamp can thus reliably be concluded from the amount of voltage loss. FIG. 2 also shows how the cathode resistance is divided. Resistance R1 comprises the resistance of the part of the cathode, along which the lamp current $I_p$ flows before it is transferred into the lamp. In FIG. 2, R2 indicates the resistance of the remaining part of the cathode. In accordance with the indications the amount of voltage loss $U_h$ caused by the lamp current can be calculated as the product of R1 and $I_p$.

FIG. 2 shows an embodiment of the invention where a voltage measurement element 5 is connected between the cathode terminals. The voltage measurement element 5 measures the voltage loss $U_h$ that is caused when the lamp current $I_p$ flows in the cathode 3 to the hot spot 7. The further the lamp current runs along the cathode the higher the voltage loss that can be measured between the cathode terminals.

The voltage measurement data is transferred to a comparing element 6 comparing the voltage loss measured with a predetermined threshold value that is determined to preferably correspond to the voltage loss which is caused when a nominally high lamp current is traveling through a resistance that is lower than the cathode resistance. Said threshold value can be chosen to be applied to each application. When the measured voltage loss exceeds the predetermined threshold value, the comparing element 6 produces an alarm signal. The alarm signal can be automatically used to perform some predetermined measures, such as connecting components to an electrical circuit. The alarm signal can also be produced as a visual signal by using, for example, a signal light indicating the alarm. The alarm signal can also, if needed, be connected to data processing systems, in which case the display may indicate the approaching end of the operating life of the fluorescent lamp.

According to another embodiment the comparing element 6 can also examine the amount of voltage loss in relation to the original voltage loss of the cathode. In accordance with the embodiment, in response to exceeding the predetermined ratio of voltages, the comparing element 6 produces an alarm signal indicating that the operating life of the fluorescent lamp is approaching its end.

The starter arrangement in FIG. 3 uses a capacitor C instead of a starter S in FIG. 1. When the starter arrangement in FIG. 3 is being used the arrangement according to FIG. 2 can be used for determining the remaining operating life of the lamp, since, when the lamp supplies light, the connections in FIGS. 1 and 3 operate in corresponding manners.

According to the principle in FIG. 4 a filament voltage providing a low continuous filament current $I_h$ through the cathodes is connected between the cathode 3 terminals of the fluorescent lamp 1 by using an electronic ballast 8. In this connection, as the fluorescent lamp ages and the hot spot 7 proceeds to the middle of the cathode 3, the current flowing through the fluorescent lamp starts to run also through the other cathode terminal. Said other cathode terminal is at a high potential compared with the second electrode in the lamp as shown in FIG. 4, in which case the lamp current can flow through both cathode terminals when the cathode resistance allows it.

Figure 5:
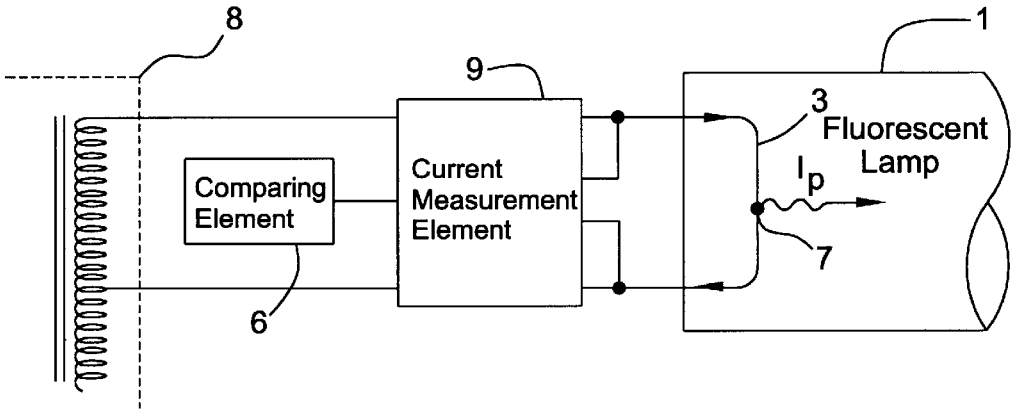
FIGS. 5 and 6 show an arrangement according to an embodiment for determining the remaining operating life of the fluorescent lamp when the electronic control gear is being used.

In accordance with the embodiment in FIG. 5 the location of the hot spot 7 and the remaining operating life of the lamp can be determined from the division of the lamp current $I_p$ between the cathode 3 terminals. A current measurement element 9 determines the ratio of the currents flowing through the cathode terminals. On the basis of said ratio the amount of active material in the fluorescent lamp cathodes can be concluded. When the amount of active material goes below the predetermined threshold, an alarm signal is produced indicating that the operating life of the fluorescent lamp is approaching its end.

Figure 6:
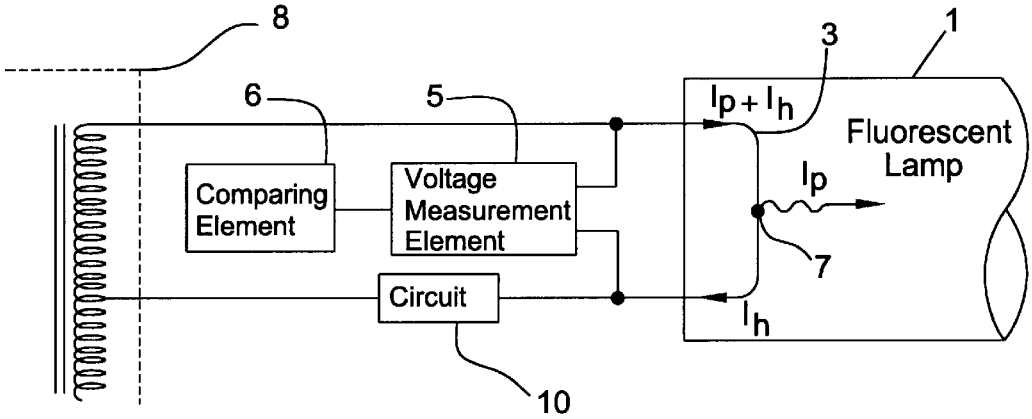

FIG. 6 shows a circuit 10, used with the electronic ballast, enabling the cathode filament current $I_h$ and the lamp current $I_p$ to travel in the same direction and in a same phase and to stop the current division according to FIG. 5. Then the transfer of the hot spot and thus the remaining amount of active material in the cathode can be reliably determined from the voltage loss between the cathode terminals.

The connection 10 associated with the cathode circuit may be an impedance that is connected to the cathode circuit together with the cathode in series and which may be resistive, capacitive, inductive or a combination thereof for unifying directions and phases of cathode and lamp currents. Instead of an impedance connection another connection or element can also be used, for example a semiconductor, allowing said same directional and cophasal flow of the currents in the cathode. When the filament current $I_h$ and the lamp current $I_p$ run in the same direction and in the same phase in the cathode, an alarm signal can in accordance with the embodiment be generated in response to a voltage loss exceeding a predetermined threshold between cathode terminals.

For those skilled in the art it is obvious that the basic idea of the invention can be implemented in various ways. The invention and its embodiments are thus not restricted to the examples above but can be modified within the scope of the attached claims.

What is claimed is:

1. A method for determining the remaining operating life of a fluorescent lamp, when the fluorescent lamp is connected to a starter and the fluorescent lamp comprises cathode, comprising the steps of measuring the cathode voltage to determine the amount of active material in the cathode and producing an alarm signal depending on the amount of remaining active material in the cathode.

2. A method as claimed in claim 1, wherein the amount of the measured voltage loss is compared to a predetermined reference value and an alarm signal is produced if the measured voltage loss exceeds the predetermined reference value.

3. An arrangement for determining the remaining operating life of a fluorescent lamp, when the fluorescent lamp is connected to a starter and the fluorescent lamp comprises cathodes, comprising means for determining the amount of remaining active material in the cathode including a voltage measurement element for measuring the voltage loss of the cathode, and means for producing an alarm signal.

4. An arrangement as claimed in claim 3, wherein the means producing the alarm signal comprises a comparing element for comparing the amount of voltage loss to a predetermined reference value.

5. An arrangement as claimed in claim 4, wherein the arrangement comprises means arranged in the cathode circuit of the fluorescent lamp enabling the current ($I_P$) flowing through the fluorescent lamp and the filament current ($I_h$) of the cathode to be same directional and cophasal.

6. An arrangement as claimed in claim 3, wherein the arrangement comprises means arranged in the cathode circuit of the fluorescent lamp enabling the current ($I_p$) flowing through the fluorescent lamp and the filament current ($I_h$) of the cathode to be same directional and cophasal.

7. An arrangement as claimed in claim 6, wherein the means arranged in the cathode circuit comprise an impedance connected in series with the cathode.

8. A method for determining the remaining operating life of a fluorescent lamp, when the fluorescent lamp is connected to a starter and the fluorescent lamp comprises cathodes, comprising the steps of measuring cathode volume loss to determine the amount of remaining active material in the cathode by observing the change in the measured voltage loss in relation to an original voltage loss, and producing an alarm signal depending on the amount of remaining active material in the cathode by producing the alarm signal when a predetermined ratio is exceeded.

9. A method for determining the remaining operating life of a fluorescent lamp, when the fluorescent lamp is connected to a starter in the form of an electronic ballast and the fluorescent lamp comprises cathodes, comprising the steps of determining the division of current between cathode terminals to determine the amount of remaining active material in the cathode, and producing an alarm signal depending on the amount of remaining active material in the cathode.

10. An arrangement for determining the remaining operating life of a fluorescent lamp, when the fluorescent lamp is connected to a starter and the fluorescent lamp comprises cathodes, comprising current measurement elements for determining the division of current between cathode terminals to determine the amount of remaining active material in the cathode, and a means for producing an alarm signal.

11. An arrangement as claim in claim 10, wherein the means arranged in the cathode circuit comprise an impedance connected in series with the cathode.

12. An arrangement as claimed in claim 10, wherein the arrangement comprises means arranged in the cathode circuit of the fluorescent lamp enabling the current ($I_p$) flowing through the fluorescent lamp and the filament current ($I_h$) of the cathode to be same direction and cophasal.

13. An arrangement as claim in claim 12, wherein the means arranged in the cathode circuit comprise an impedance connected in series with the cathode.

* * * * *